United States Patent [19]

Leonakis

[11] Patent Number: 5,025,233

[45] Date of Patent: Jun. 18, 1991

[54] BROADBAND POWER DIVIDER

[75] Inventor: George L. Leonakis, Redondo Beach, Calif.

[73] Assignee: Hughes Aircraft Company, Los Angeles, Calif.

[21] Appl. No.: 331,555

[22] Filed: Mar. 31, 1989

[51] Int. Cl.[5] ..... H01P 5/02

[52] U.S. Cl. ..... 333/128; 333/238

[58] Field of Search ..... 333/127, 128, 136

[56] References Cited

U.S. PATENT DOCUMENTS

| | | | |
|---|---|---|---|
| 2,877,427 | 3/1959 | Butler | 333/128 |
| 4,310,814 | 1/1982 | Bowman | 333/128 X |
| 4,835,496 | 3/1989 | Schellenberg et al. | 333/128 |

*Primary Examiner*—Paul Gensler

*Attorney, Agent, or Firm*—Leonard A. Alkov; Wanda K. Denson-Low

[57] ABSTRACT

A compact, high efficiency, highpass, broadband microwave power divider is provided which has an even mode characteristic impedance and an odd mode characteristic impedance which are tapered to equal the characteristic impedance of the output load. The broadband power divider 10 of the present invention includes an input section 1 of conductive material; N tapered sections of conductive material 6, 7, 8 and 9, where N is greater than or equal to 2, extending from and integral with the input section 1; and N output sections of conductive material 2, 3, 4 and 5 each output section extending from and integral with a respective one of the tapered sections 6, 7, 8 and 9.

16 Claims, 5 Drawing Sheets

FIG. 1
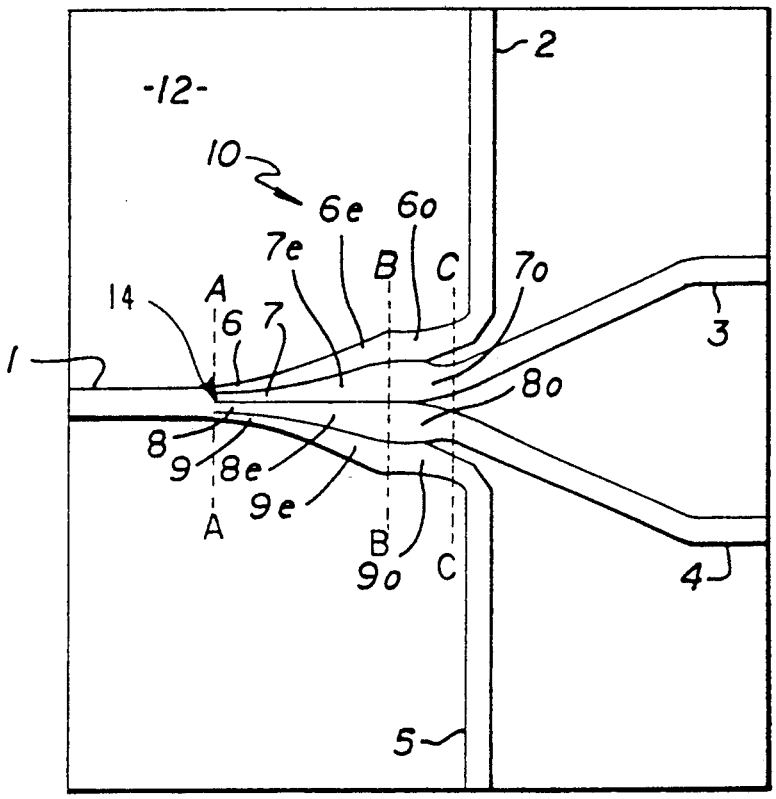
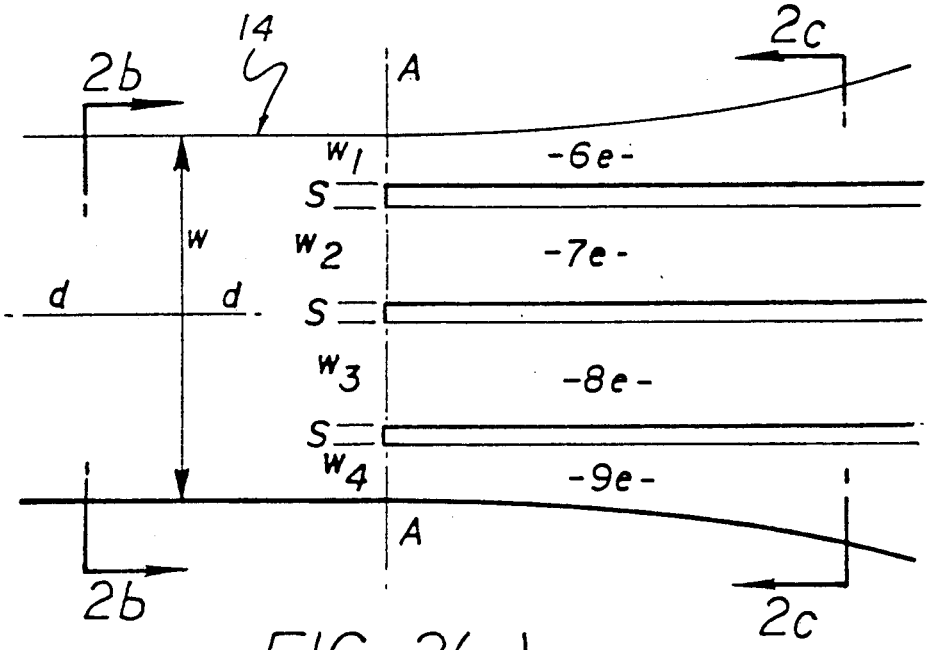
FIG. 2(a)

FIG. 2(b)
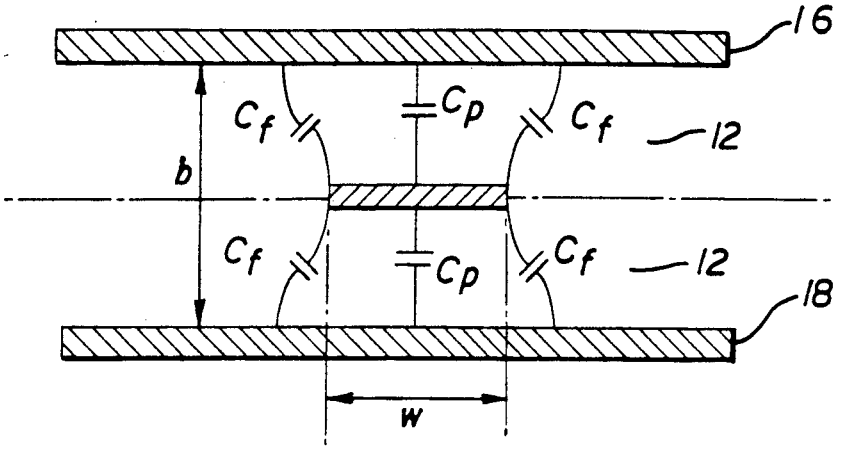
FIG. 2(c)
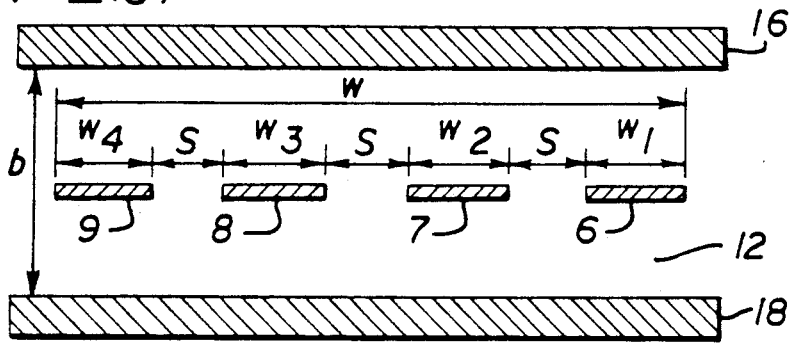
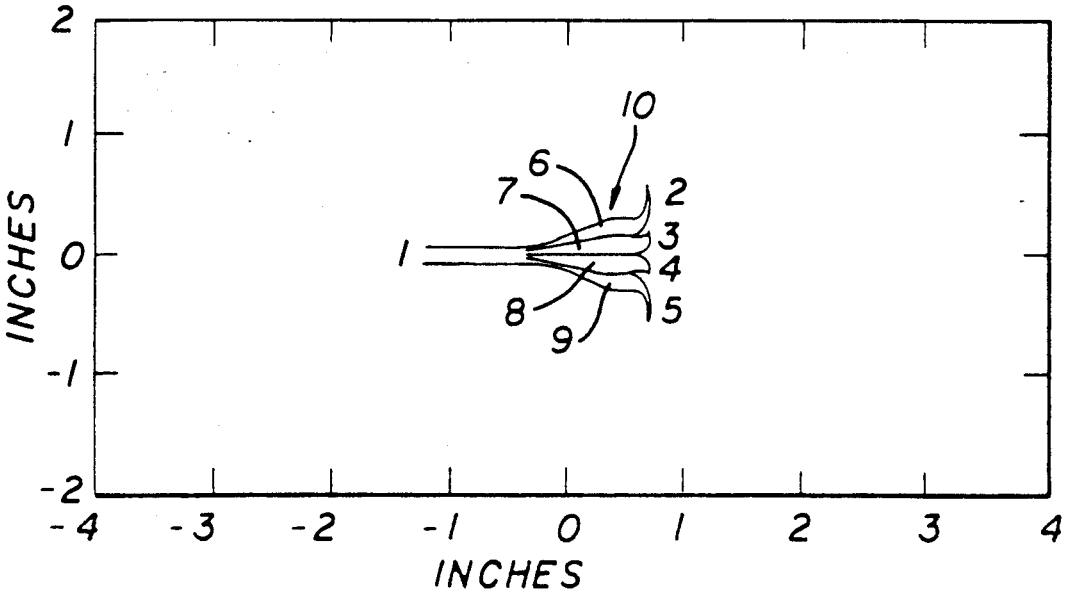
FIG. 3

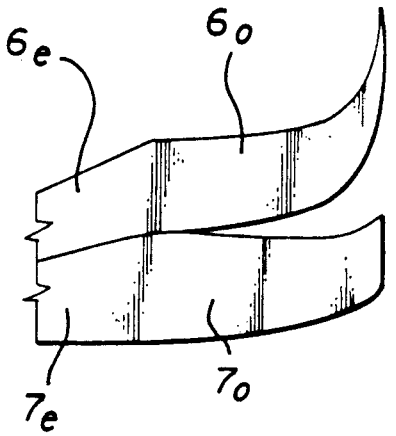
FIG. 4
FIG. 5
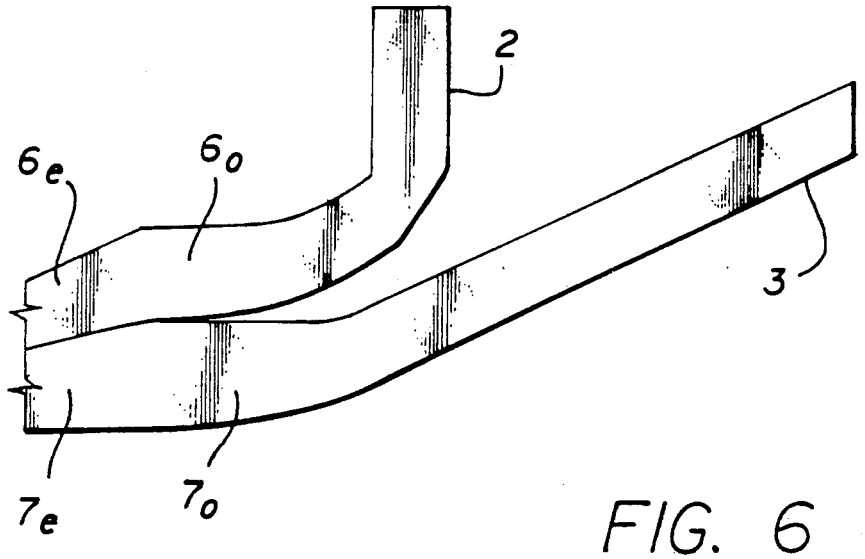
FIG. 6
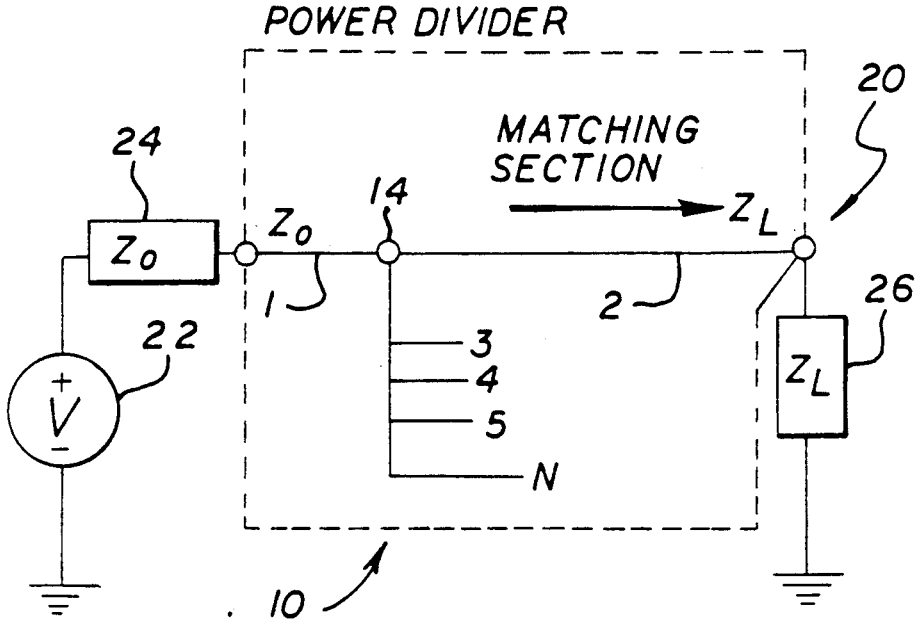

FIG. 7
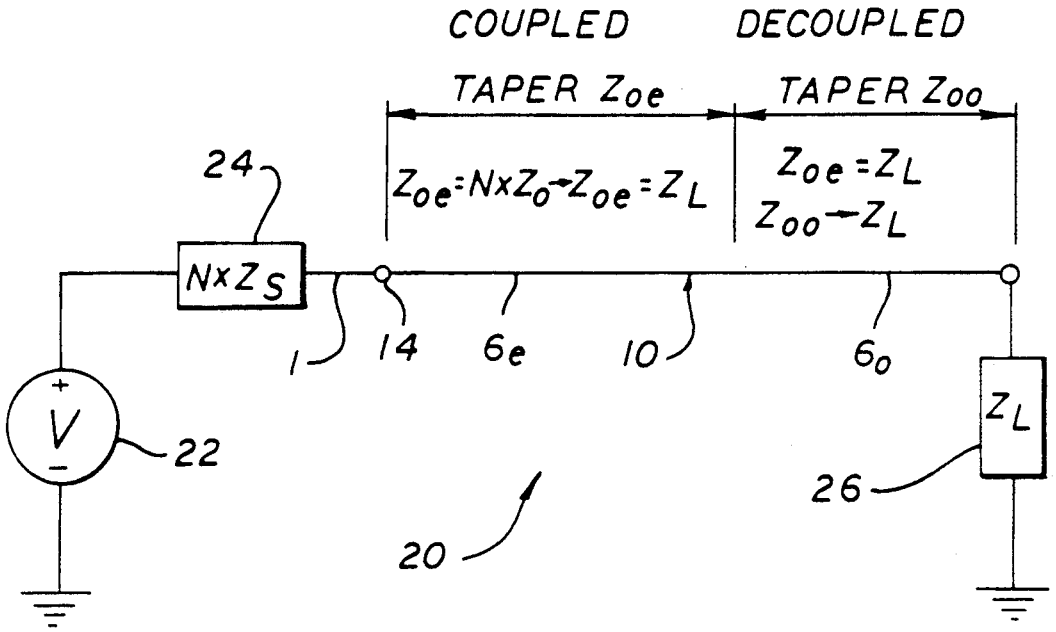
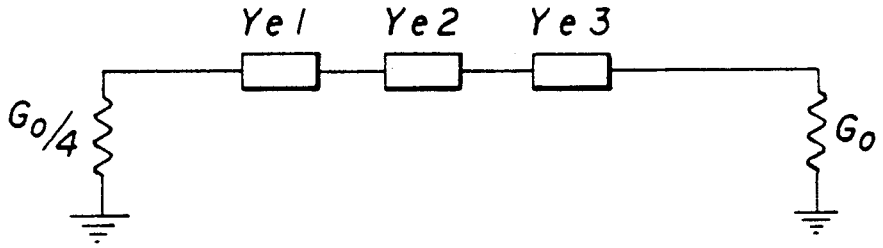
FIG. 8(a)
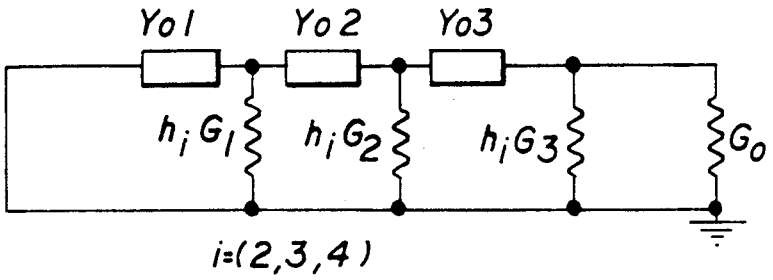
FIG. 8(b)

BROADBAND POWER DIVIDER

BACKGROUND OF THE INVENTION

1. Field of the Invention

The present invention relates to power dividers. More specifically, the present invention relates to microwave power dividers.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Power dividers are known and used widely in the art to divide power in an input path into two or more output paths. When energy flows in an opposite direction through a power divider, the power divider acts as a power combiner.

Cascaded power dividers are particularly well known in the art. A simple conventional power divider splits input power between two output paths. It is therefore regarded as a 2:1 power divider. Where more than two outputs are desired, the simple power dividers are cascaded end-to-end. For example, where it is desired to provide a four-way division of input power, three simple 2:1 conventional power dividers are cascaded. Two of the power dividers are input connected to the third divider at the outputs thereof.

As the length of the power dividers is determined with regard to the need to match the impedance and/or other electrical characteristics of a transmission line, the cascading of power dividers often results in a power divider which is relatively long. The length of a power divider is directly related to its loss and may impose space constraints on a host system.

Single junction power dividers do not generally suffer the length problems of cascaded designs. Single junction power dividers include several taps from a single junction. While the taps are generally small in width at the junction, the taps include a section which has a discrete increase in width for impedance matching purposes. Because of the discrete step change in width, single junction power dividers are characterized by a rather limited passband. See "A Broadband Planar N-Way Combiner/Divider" published in IEEE MTT-S on June 1977 by Z. Galani and S. J. Temple, pp. 499–502.

A paper entitled "A New N-Way Broadband Planar Power Combiner/Divider", published in Microwave Journal on November 1986 by W. Yau, J. M. Schellenberg, and Y. C. Shih pp. 147–150 appears to disclose a single junction power combiner/divider utilizing a tapered transmission line. However, this device is not a power divider, per se, as power is divided internally, amplified and combined at a single junction prior to being output. Also, even if the device is modified to provide a power divider, the individual transmission lines in the device are probably too close electrically to avoid impedance matching problems. In addition, the size of the device would be such that it would be somewhat difficult to make attachments at the outputs thereof.

Thus, there is a need in the art for a compact, broadband, highpass, high efficiency microwave power divider.

SUMMARY OF THE INVENTION

The need in the art is addressed by the broadband power divider of the present invention which includes an input section of conductive material; N tapered sections of conductive material, where N is greater than or equal to 2, extending from and integral with the input section; and a number N of output sections of conductive material, each output section extending from and integral with a respective one of the tapered sections.

In a particular embodiment, the invention provides a broadband power divider adapted for connection to a transmission line which includes an input section of conductive material having a characteristic impedance which is equal to the characteristic impedance of the transmission line. A number N of tapered sections of conductive material (where N is greater than or equal to two) extend from and are integral with the input section. Each of the tapered sections includes an even mode subsection having a first taper and an odd mode subsection having a second taper. Each of the first taper sections begins with an even mode characteristic impedance such that the even mode characteristic impedance value of all the first taper sections even mode impedance values taken in parallel at the junction with the input section is equal to the characteristic impedance of the input section for equal or unequal power division. N output sections of conductive material are included. Each output section extends from and is integral with a respective one of the tapered sections. Each of the output sections has an even mode characteristic impedance which is equal to the characteristic impedance of the output load with which the output section is attached and an odd mode characteristic impedance which is equal to the characteristic impedance of the output load with which the output section is attached. Thus, a compact, high efficiency, highpass, broadband microwave power divider is provided which has an even mode characteristic impedance and an odd mode characteristic impedance which is tapered to equal the characteristic impedance of the output loads with which it is attached.

BRIEF DESCRIPTION OF THE DRAWINGS

FIG. 1 shows an illustrative embodiment of a compact, high efficiency, highpass, broadband microwave power divider constructed in accordance with the teachings of the present invention.

FIG. 2(*a*) shows an expanded view of the junction of the illustrative embodiment of a power divider constructed in accordance with the teachings of the present invention.

FIG. 2(*b*) shows a sectional end view of the power divider illustrated in FIG. 2(*a*) looking in from the input port.

FIG. 2(*c*) shows a sectional end view of the power divider illustrated in FIG. 2(*a*) looking back toward the input port.

FIG. 3 shows a theoretical taper design of the power divider of the present invention resulting from the design methodology of the present invention.

FIG. 4 illustrates the need to alter the end of the theoretical taper of the power divider of the present invention to allow use with coaxial connectors or other types of connections.

FIG. 5 shows how the output branches of the theoretical design of the power divider of the present invention are altered for connection compatibility.

FIG. 6 shows a schematic diagram of a circuit utilizing a power divider of the present invention.

FIG. 7 shows an equivalent circuit for individual line of the power divider of the present invention connected to a driving source and a load.

FIGS. 8(*a*) and 8(*b*) show the equivalent circuit representations with averaged even an odd mode characteristic admittance values for the even mode and the odd mode of operation of an output line of the power divider of the present invention, respectively.

DESCRIPTION OF THE INVENTION

Figure 9:
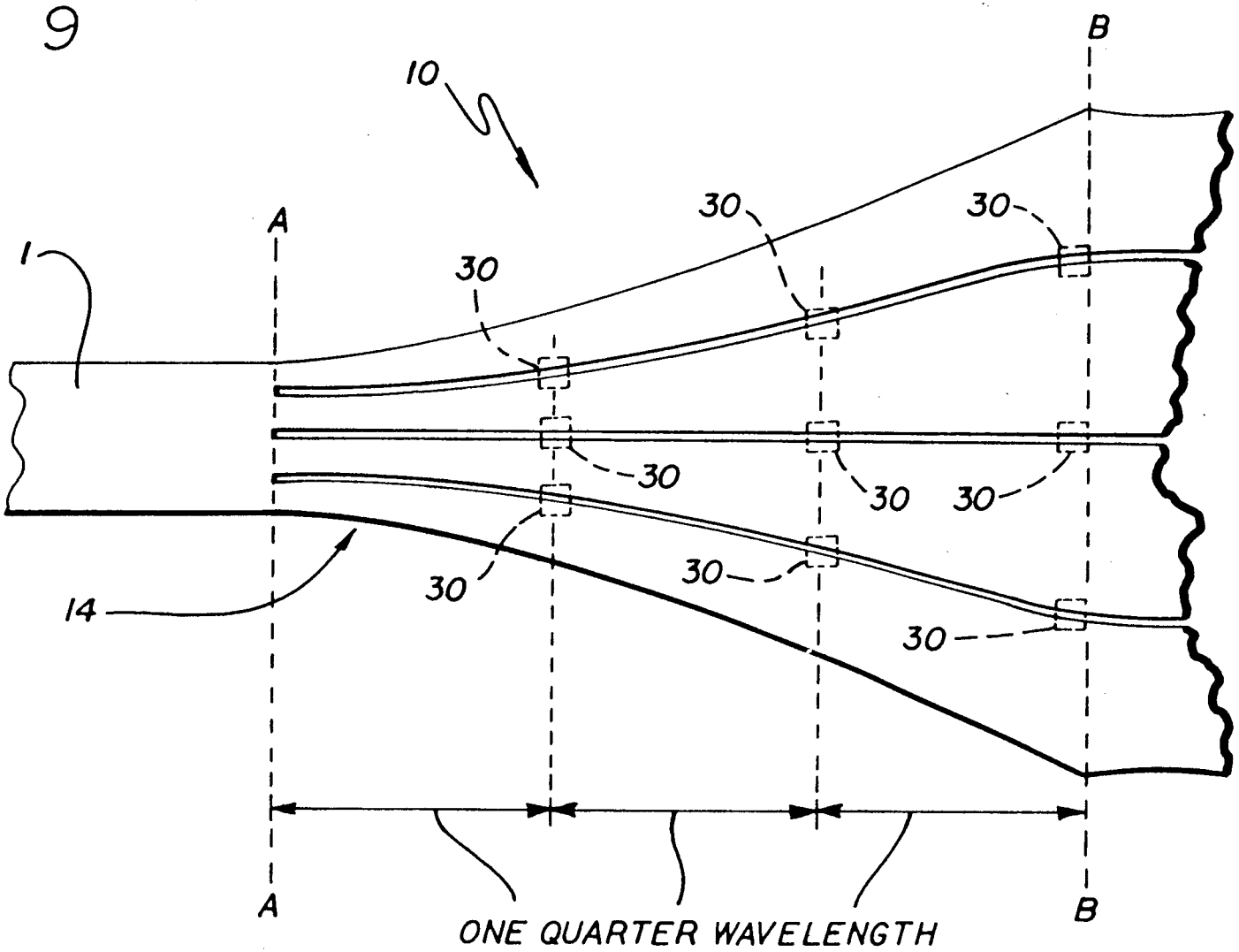
FIG. 9 depicts a network of transmission lines connected to a driving source.

An illustrative embodiment of a compact, high efficiency, highpass, broadband microwave power divider, constructed in accordance with the teachings of the present invention, is shown in FIG. 1. In the preferred embodiment, the power divider 10 is constructed of copper stripline on a glass reinforced dielectric substrate 12. Those skilled in the art will appreciate that the invention is not limited to the materials disclosed for use in connection with the construction of the illustrative embodiment.

The power divider 10 includes a first common port or section 1 and second, third, fourth and fifth sections 2, 3, 4, and 5, respectively. In an even mode of operation by which power is input to the first section 1 and divided between the second, third, fourth and fifth sections 2, 3, 4, and 5, respectively, the first section 1 provides an input port and the second, third, fourth and fifth sections 2, 3, 4, and 5, provide output ports. Also, in another even mode of operation by which power is input to the second, third, fourth, and fifth sections 2, 3, 4, and 5, respectively, in phase and combined in the first section 1, the second, third, fourth, and fifth sections 2, 3, 4, and 5 provide an input port and the first section 1 provides an output port. Thus, in this even mode of operation, the power divider functions as a combiner.

In an odd mode of operation, power is input to one of the second, third, fourth and fifth sections 2, 3, 4, and 5, and is output via the first section 1. Unless otherwise specified herein, the even mode of operation will be assumed for the power divider 10. Accordingly, the first section 1 will hereinafter be referred to as the "input port" 1 and the second, third, fourth and fifth sections 2, 3, 4, and 5, will be referred to as "output ports" 2, 3, 4, and 5 respectively. Those skilled in the art will recognize the power divider 10 of FIG. 1 as a four-way power divider.

Each of the output ports 2, 3, 4 and 5 is connected to the input port 1 by a tapered section 6, 7, 8 and 9 respectively. Each tapered section 6, 7, 8 and 9 includes an even mode tapered section $6_e$, $7_e$, $8_e$ and $9_e$, respectively, from the junction 14 of the power divider 10 at line 'AA' to the line 'BB' which is connected to and integral with an odd mode tapered section $6_o$, $7_o$, $8_o$ and $9_o$, respectively, between lines 'BB' and 'CC' in FIG. 1. In the preferred embodiment the two outer sections 6 and 9 are symmetric about the centerline dd of the power divider 10 shown in FIG. 2(*a*). The two center sections 7 and 8 are also symmetric about the centerline dd of the power divider 10. The sections 6, 7, 8 and 9 are separated by a small distance 's' typically the minimum detachable distance leaving the sections 6, 7, 8 and 9 electromagnetically coupled to one another.

In the preferred embodiment, the power divider 10 is designed to provide an impedance $Z_o$ which matches the impedance $Z_o$ of the incoming transmission line of the host circuit (not shown) and an impedance $Z_L$ which matches the impedance $Z_L$ of the output transmission line or load. Thus, for a typical microwave application, the input port would have a characteristic impedance of 50 ohms. The even mode characteristic impedance going into the output ports 2, 3, 4 and 5 is designed to be equal to $N \times Z_o$ for equal power division for each section at the junction 14, where N is the number of branches or output ports. Thus, in the case of the illustrative embodiment of FIG. 1, where N=4, power input to the power divider 10 via the input port 1 sees four sections of 200 ohms impedance each all in parallel with each other for a net impedance of 50 ohms. The even mode impedance of each section 6, 7, 8 and 9 is then tapered from $N \times Z_o$ to the impedance of the outputs connected thereto $Z_L$, typically 50 ohms, in the even mode tapered sections $6_e$, $7_e$, $8_e$ and $9_e$, respectively, while maintaining the separation distance s. In the preferred embodiment, the design of the even mode tapered sections $6_e$, $7_e$, $8_e$ and $9_e$ was performed in a length of approximately ¾ wavelengths along the longitudinal axis of the power divider 10 at the center frequency of operation, e.g. 12 gigahertz (GHz). In the preferred embodiment the taper was designed with the sections $6_e$, $7_e$, $8_e$ and $9_e$ being held at a fixed distance e.g., s=4 mils a part from one another, at which the sections remained electromagnetically coupled. The lines were then separated by tapering the odd mode impedance of each section $6_o$, $7_o$, $8_o$ and $9_o$, from the associated given value of odd mode impedance at the end of the even mode taper to the impedance of the outputs $Z_L$ while keeping the even mode impedance constant at $Z_L$.

Thus, the tapered sections 6, 7, 8 and 9 allow for the N way split of power and impedance matching by the power divider 10 of the present invention. In addition, the tapered sections provide a highpass response, broadband performance and a shorter length than conventional power dividers.

FIG. 2(*a*) shows an expanded view of the junction 14 of the power divider 10 of the illustrative embodiment. FIG. 2(*b*) shows a sectional end view of the power divider looking in from port 1. FIG. 2(*c*) shows a sectional end view of the power divider looking back toward port 1. Note that the even mode tapered sections $6_e$, $7_e$, $8_e$ and $9_e$ have widths $w_1$, $w_2$, $w_3$, and $w_4$ respectively. Note also that $w_1=w_4$ and $w_2=w_3$ at any point along the centerline dd for this embodiment. Each section is separated from the adjacent section by the distance s. Thus, the total width w of the input section 1 is equal to the sum of the widths of the individual sections and three times the spacing distance $w_1+w_2+w_3+w_4+3s$ at the junction shown at line AA. FIGS. 2(*b*) and 2(*c*) illustrate that the stripline power divider 10 is mounted between two boards of dielectric substrate material 12 having a total thickness b. The dielectric boards 12 are sandwiched between two ground planes of aluminum or other suitable material 16 and 18.

DESIGN

A power divider may be designed and constructed in accordance with the present teachings as follows:

1. Choose the desired number of branches N, the characteristic impedance $Z_o$ of the incoming transmission line, the ground plane spacing 'b' for the total thickness of the two dielectric substrate boards, and the associated relative dielectric constant $\epsilon_r$ of the boards.

2. Compute the width 'w' of the line for the input section at the junction 14 for the impedance $Z_o$ in accordance with equation [8] below:

$$u' = b\left(\frac{94.18/\sqrt{\epsilon_r}}{Z_O} - \frac{2\ln 2}{\pi}\right)\text{mils.} \quad [8]$$

In the illustrative embodiment, the characteristic impedance $Z_o$ of the line was 50 ohms, the relative dielectric constant $\epsilon_r = 2.17$, and the ground plane spacing $b = 124$ mils. The constant $\pi$ is the standard value.

3. Determine the minimum separation distance s. This, most likely, will be determined by the ability to etch the separation distance to the smallest value possible.

4. Compute the widths $w_1$ and $w_2$ at the junction 14 for each of the four tapered sections 6, 7, 8 and 9 with the use of equations [19] and [18] below:

$$w_2 = \frac{w - 3s}{4} - \frac{b}{2\pi}\left[\ln\left(1 + \tanh\left(\frac{\pi s}{2b}\right)\right)\right]\text{mils,} \quad [19]$$

$$w_1 = \frac{w - 3s}{2} - w_2 \text{ mils.} \quad [18]$$

where $w_1$ and $w_2$ are the outer and center widths respectively. In the preferred embodiment $w_4$ and $w_3$ are equal to $w_1$ and $w_2$ respectively, throughout the design.

5. Compute the even mode impedance values for points along the even mode taper for the outer section and the inner section. Use equations [24] and [27] below to calculate the initial starting value of the even mode impedance taper.

6. Compute the even mode impedance from the initial starting value to the desired ending value $Z_L$ for the desired tapered even mode section length (minimum $\frac{3}{4}\lambda$ at the center frequency of operation for isolation network purposes in the presented embodiment):

$$Z_{0e1} = \frac{94.18/\sqrt{\epsilon_r}}{\frac{w_1}{b} - \frac{\ln 2}{\pi} - \frac{1}{\pi}\ln\left(1 - \tanh\left(\frac{\pi s}{2b}\right)\right)}\ \Omega. \quad [24]$$

$$Z_{0e2} = \frac{94.18/\sqrt{\epsilon_r}}{\frac{w_2}{b} + \frac{2}{\pi}\ln\left(1 - \tanh\left(\frac{\pi s}{2b}\right)\right)}\ \Omega. \quad [27]$$

In equations [24] and [27] $Z_{oe1}$ is the even mode impedance of the outer even mode tapered sections $6_e$ and $9_e$ and $Z_{oe2}$ is the even mode impedance of the center even mode tapered sections $7_e$ and $8_e$. In this embodiment the even mode impedances of all sections are equal at the junction 14. In this embodiment the even mode impedances of all sections are equal to one another for a given distance along the length of the branches. In this embodiment this distance is taken along the center line dd of the power divider. Thus, the same even mode impedance taper was used for all sections in this embodiment. In the illustrative embodiment, the even mode impedance was tapered from a initial value of approximately 200 ohms at the junction 14 to 50 ohms using a Chebychev impedance taper. (While the Chebychev impedance tapering routine is known in the art, an illustrative program for providing a Chebychev impedance taper is provided in Appendix A. This technique is also described in "A Transmission Line Taper of Improved Design", published in IRE on January 1956 by R. W. Klopfenstein, pp. 31–35. The invention is not limited to the technique used to provide impedance tapers.) As mentioned above, the length of the taper in the illustrative embodiment was $\frac{3}{4}$ of a wavelength at 12 GHz.

(Although, in the illustrative embodiment, the impedance $Z_{oe}$ at the junction should be 200Ω ($N \times Z_o$) the actual impedance is insignificantly higher because of the introduction of the spacing "s" between the lines. The equations for the line widths $w_1$ and $w_2$ have the condition that only their even mode impedances be equal to one another. These impedance values are not exactly equal to 200Ω but are only slightly higher because of the introduction of the spaces.)

7. Compute the section widths for points along the taper with the use of the tapered even mode impedance values and equations [32] and [33]. Note that x is the distance along a center line dd of the power divider starting from line AA and ending at line BB.

$$w_1(x) = b\left[\frac{94.18/\sqrt{\epsilon_r}}{Z(x)} - \frac{\ln 2}{\pi} - \frac{1}{\pi}\ln\left(1 + \tanh\left(\frac{\pi s}{2b}\right)\right)\right]\text{mils.} \quad [32]$$

$$w_2(x) = b\left[\frac{94.18/\sqrt{\epsilon_r}}{Z(x)} - \frac{2}{\pi}\ln\left(1 - \tanh\left(\frac{\pi s}{2b}\right)\right)\right]\text{mils.} \quad [33]$$

This completes the design of the even mode tapered region.

8. To design the edge section odd mode taper, compute the edge section odd mode impedance at the beginning of the odd mode tapered region for edge sections $6_o$ and $9_o$ (at line BB in FIG. 1.), use equation [39] below and the last values of $w_1$ and s from the even mode taper region at line BB in FIG. 1. $X_{odd}$ is the distance along the center line dd of the power divider starting at BB and ending at CC.

$$Z_{0o1}(x_{odd}) = \frac{94.18/\sqrt{\epsilon_r}}{\frac{w_1(x_{odd})}{b} - \frac{\ln 2}{\pi} - \frac{1}{\pi}\ln\left(1 - \coth\left(\frac{\pi s_1(x_{odd})}{2b}\right)\right)}\ \Omega. \quad [39]$$

The last values of $w_1$ and s from the even mode taper region are used as the initial values of $w_1(x_{odd})$ and $s_1(x_{odd})$ in the impedance taper for the edge line in the odd mode taper region. The initial values of line width $w_1(x_{odd})$ and $s_1(x_{odd})$ are used to determine the starting value of the odd mode impedance at BB.

9. Compute the Chebychev odd mode impedance values for points along the taper from the starting value determined above to the final impedance value $Z_L$. In the preferred embodiment, the specified odd mode taper length from BB to CC was $\lambda/8$ at the center frequency of 12 Ghz.

10. Compute the spacing $s_1(x_{odd})$ which is the spacing between the outer conductor of width $w_1(x_{odd})$ and the adjacent conductor of width $w_2(x_{odd})$ with equation [54] below for points along the taper:

$$s_1(x_{odd}) = \frac{2b}{\pi}\tanh^{-1}\left(\frac{1}{\xi_1(x_{odd})}\right)\text{mils.} \quad [54]$$

where $\xi_1(x_{odd})$ is provided by equation [56] below and represents a simple substitution variable for the right side of equation [56]. In equation [56] $Z_{oe1}(x_{odd})$ is held constant at $Z_L$ and the values for $Z_{oo1}(x_{odd})$ are Chebychev impedance taper values determined along the distance $x_{odd}$:

$$\xi_1(x_{odd}) = \exp\left[\frac{94.18\pi}{\sqrt{\epsilon_r}}\left(\frac{1}{Z_{0o1}(x_{odd})} - \frac{1}{Z_{0e1}(x_{odd})}\right)\right]. \quad [56]$$

11. Compute the spacing width $w_1(x_{odd})$ with equation [55] below for points along the taper:

$$w_1(x_{odd}) = b\left[\frac{94.18/\sqrt{\epsilon_r}}{Z_{0e1}(x_{odd})} - \frac{\ln 2}{\pi} - \frac{1}{\pi}\ln\left(1 - \tanh\left(\frac{\pi s_1(x_{odd})}{2b}\right)\right)\right]\text{mils.} \quad [55]$$

12. To design the center section odd mode taper, compute the center section odd mode impedance at the beginning of the odd mode tapered region for center sections $7_o$ and $8_o$ (at line BB in FIG. 1). Use equation [60] below and the last values of $w_2$ and s from the even mode taper region at BB:

$$Z_{0o2}(x_{odd}) = 94.18/\sqrt{\epsilon_r}\Big/\left[\frac{w_2(x_{odd})}{b} - \frac{1}{\pi}\ln\left(1 - \coth\left(\frac{\pi s_1(x_{odd})}{2b}\right)\right) - \frac{1}{\pi}\ln\left(1 - \coth\left(\frac{\pi s_2(x_{odd})}{2b}\right)\right)\right]\Omega. \quad [60]$$

13. Compute the Chebychev odd mode impedance values for points along the taper from the starting value of $Z_{oo2}$ determined above to the final impedance value $Z_L$.

14. Compute the spacing $s_2(x_{odd})$ (which is the spacing between the two center conductors of width $w_2(x_{odd})$) with equation [66] below for points along the taper, where $\xi_2(x_{odd})$ is provided by equation [68]. In equation [68]$Z_{oe2}(x_{odd})$ is constant at $Z_L$ and the values for $Z_{oo2}(x_{odd})$ are Chebychev impedance taper values determined along the distance $x_{odd}$:

$$s_2(x_{odd}) = \frac{2b}{\pi}\tanh^{-1}\left(\frac{1}{\xi_2(x_{odd})}\right)\text{mils.} \quad [66]$$

-continued $$\xi_2(x_{odd}) = \exp\left[\frac{94.18\pi}{\sqrt{\epsilon_r}}\left(\frac{1}{Z_{0o2}(x_{odd})} - \frac{1}{Z_{0e2}(x_{odd})}\right) + \frac{1}{\pi}\ln\left(1 - \tanh\left(\frac{\pi s_1(x_{odd})}{2b}\right)\right) - \frac{1}{\pi}\ln\left(1 - \coth\left(\frac{\pi s_1(x_{odd})}{2b}\right)\right)\right]. \quad [68]$$

15. Compute the width $w_2(x_{odd})$ with equation [67] below for points along the taper:

$$w_2(x_{odd}) = b\left[\frac{94.18/\sqrt{\epsilon_r}}{Z_{0e2}(x_{odd})} - \frac{1}{\pi}\ln\left(1 - \tanh\left(\frac{\pi s_1(x_{odd})}{2b}\right)\right) - \frac{1}{\pi}\ln\left(1 + \tanh\left(\frac{\pi s_2(x_{odd})}{2b}\right)\right)\right]\text{mils,} \quad [67]$$

where $Z_{oe2}(x_{odd})$ is held constant over the distance $x_{odd}$ and $s_1(x_{odd})$ and $s_2(x_{odd})$ are the values previously calculated for this region.

16. All the line widths and spacings are now computed and are output to a data file that will list the points in the order that a table plotter can cut the outline of the power divider from a Rubylith mask or similar purpose material, ideally, without lifting the cutting tool. Rubylith is provided by the Ulano Corporation of Brooklyn, N.Y. Then the sections 6, 7, 8 and 9 are extended at a point where the line space to ground plane ratios s/b are approximately equal to or greater than 1. FIG. 3 shows a resulting theoretical taper design. FIG. 4 shows an enlargement of the end of the theoretical taper of the power divider at ports 2 and 3. FIG. 5 shows how ports 2 and 3 are extended to go to an output connection. In the illustration of FIG. 5, note that the s/b ratio at the point where the edge lines were drawn out was 0.37 which means the odd mode impedance was 46 ohms which is 4 ohms from the final single line value of 50 ohms. The even mode impedance value is already at 50 ohms.

The data file from the tapering program is edited to extend the lines to the output connections and then the data file is input to a plotter from which the mask is cut. The mask is then used to etch the power divider 10 in a conventional manner. FIGS. 3 and 1 show the before and after shape of the power divider 10, respectively.

17. Next, compute isolating resistor values and mount the resistors 30 as shown in FIG. 9 on the power divider 10 at quarter-wave spacings of the center frequency of matching, i.e., 12 Ghz in the illustrative embodiment. (The mounting begins one quarter wavelength from the junction 14.) The isolation resistor design program of Appendix B may be used for this purpose although the invention is not limited thereto. For the preferred embodiment, the isolation resistor network was designed in accordance with the teaching of Nagai in "New N-Way Hybrid Power Dividers." by N. Nagai, E. Maekawa, and K. Ono, in IEEE Trans. MTT., vol. MTT-25 no. 12, pp. 1008–1012, Dec., 1977.

The isolation resistor network is used to dampen signals that propagate in the odd mode. A pure odd mode exists when, for example, one of the output branches is excited with a signal which travels into the power divider 10 and then returns from the junction 14 on the adjacent lines producing unequal potentials between lines at the same points along the taper.

The power divider 10 of the present invention may operate as a power combiner. Four signals coming into the power divider 10 from the four output branches can be combined as long as they are in phase and for equal power combination of the same voltage amplitude. However, if the signals are out of phase or have different voltage amplitudes, there will be current flow through the resistor network that will reduce the amplitude difference by consuming the energy of the signal.

The resistors 30 are placed in multiples of one-quarter wavelengths from the junction of the power divider 10 so that when current travels from one of the output ports 2, 3, 4 or 5, an odd multiple of one-quarter of a wavelength from a resistor to the junction and then back to the resistor, it is 180 degrees out of phase with the current on the originating line. The resistor value is chosen such that the voltage amplitude of the signal that crosses the resistor to an adjacent line is the same as a signal that travels from the resistor to the junction 14 and back on the same adjacent line to the other side of the resistor. Cancellation can occur at the other output port because of the equal but opposite potentials.

There is no current flow across the resistors in the common mode where power is divided or combined unless there are unequal potentials between adjacent lines at the same distance points along the taper. Such points of unequal potentials are caused by reflections arising from impedance mismatches due to construction imperfections. These reflections are also considered as odd modes that are consumed in the resistor network.

The isolation resistors 30 are optional and are therefore shown in phantom in FIG. 9.

FIG. 6 shows a schematic diagram of a circuit 20 utilizing a power divider 10 of the present invention. The power divider 10 is shown as a network of transmission lines 2 - N connected to a driving source 22, with a source impedance $Z_{o24}$, the input port 1 at junction 14. The characteristic impedance of the input port or section 1 is $Z_o$. Each section 2 - N may be connected to a load or termination 26 having an impedance $Z_L$. The even mode impedance of each section going into ports 2 - N is tapered to match the impedance of the load from $N \times Z_o$ at the junction 14 to $Z_L$.

FIG. 7 shows an equivalent circuit of an individual line of the power divider connected to a driving source and a load $Z_L$. The even mode impedance of the line was tapered from $N \times Z_o$ to $Z_L$ as discussed above. The sections are then separated by tapering the odd mode impedance of each line from its given value at the end of the even mode taper to the load value of $Z_L$ while keeping the even mode impedance constant.

FIGS. 8(*a*) and 8(*b*) show the equivalent circuit representations with average even and odd mode admittance values for the even mode and the odd mode of operation of the power divider 10 of the present invention respectively. $Y_e$ and $Y_o$ represent the average of the even and odd mode admittance for the given quarter-wavelength region. The $h_i$ variables are the eigenvalues explained in the above-referenced Nagai paper which is incorporated herein by reference. G is the conductance of the resistors to be determined. The conductance is inverted to give the resistance values of the resistors in the network.

Several approximations and assumptions were made in connection with the implementation of the present invention in accordance with the present teachings. For example, the line impedance values in all cases were calculated using the assumption that the conductor had zero thickness. The actual thickness could, however, be taken into account as more complicated equations for this do exist. See "Characteristic Impedance of the Shielded-Strip Transmission Line." by S. B. Cohn, IRE Trans., vol. MTT-2, pp. 52–57, Jul., 1954 and "Shielded Coupled-Strip Transmission Line", by S. B. Cohn, IRE Trans., MTT, vol. MTT-3, pp. 29–38. Oct. 1955. The etching of the conductor was not extremely accurate because stripline was used. The photo negative mask was made on standard acetate and not glass. The lab procedures used for etching the power divider were standard. This gave an etch factor of about 2 mils on the edge of the conductor. The impedance accuracy of the zero thickness assumption was sufficient. The impedance equations for stripline, as given by Cohn above, require the width to ground plane ratio w/b to be about 0.35 or greater in order to be used. For smaller w/b ratios, a different set of equations is normally used which is for coupled circular center conductors. The error from the exact elliptic integral solution at $w/b=0.35$ is only 1.2% for both sets of equations. The w/b ratio right at the junction where the lines are cut out is less than 0.35 but it was determined that the error from using the stripline equations was only on the order of a few percent. The actual w/b ratio was 0.08 at the junction 14 in the preferred embodiment. It was also determined that if the set of equations for the coupled circular conductors was used when the ratio was under 0.35, and the set of equations for the coupled stripline conductors was used when the ratio was over 0.35, there would be a line width difference right at the point where the w/b ratio was equal to 0.35. This discontinuity in the conductor widths is not desired and would be awkward to construct. The capacitances between lines that were not adjacent to one another were negligible. This implies that there is no interaction between nonadjacent lines. It was assumed that propagation along the conductor through the substrate was lossless. The impedance of the lines to be tapered is real and independent of frequency. It was also assumed that if the impedance discontinuities of the true Chebychev impedance taper were left out this would not significantly alter the reflection characteristics of the taper.

Thus, the present invention has been described herein with reference to a particular embodiment for a particular application. Those having ordinary skill in the art and access to the present teachings will recognize additional modifications, applications and embodiments within the scope thereof. For example, the invention is not limited to the technique used to provide impedance tapers. Further, an exponential taper or other taper may be used without departing from the scope of the invention. Microstrip may be used instead of stripline. And power division can be made with power being divided unequally at the junction 14.

It is therefore intended by the appended claims to cover any and all such applications, modifications and embodiments within the scope of the present invention.

Accordingly,

What is claimed is:

1. A broadband power divider comprising:

an input section of conductive material;

N tapered sections of conductive material, where N is greater than or equal to 2, extending from and integral with said input section, each of said tapered sections including an even mode subsection having a first taper and an odd mode subsection having a second taper; and N output sections of conductive material, each output section being electromagnetically decoupled from the other output sections and each output section extending from and integral with a respective one of said tapered sections.

2. The invention of claim 1 wherein said N tapered sections are electromagnetically coupled to each other.

3. The invention of claim 1 wherein said broadband power divider is adapted for connection to a transmission line having a characteristic impedance and said broadband power divider includes a section tapered such that said broadband power divider has a characteristic impedance which is equal to the characteristic impedance of said transmission line.

4. The invention of claim 3 wherein the said input section has a characteristic impedance which is equal to the characteristic impedance of said transmission line at the connection thereof with said transmission line.

5. The invention of claim 4 wherein each of said tapered sections has an even mode characteristic impedance equal to the characteristic impedance of the input section at the junction with the input section.

6. The invention of claim 4 wherein each of said tapered sections has an even mode characteristic impedance which is equal to N times the characteristic impedance of the input section at the junction with said input section for equal power division.

7. The invention of claim 6 wherein each of said output sections has an even mode characteristic impedance which is equal to the characteristic impedance of a load.

8. The invention of claim 7 wherein each of said output sections has an odd mode characteristic impedance which is equal to the characteristic impedance of said load.

9. A broadband power divider adapted for connection to a transmission line, said broadband power divider comprising:

an input section of conductive material, said input section having a characteristic impedance which is equal to the characteristic impedance of said transmission line;

N tapered sections of conductive material extending from and integral with said input section, where N is greater than two, each of said tapered sections including an even mode subsection having a first taper and an odd mode subsection having a second taper, each of said first tapered sections having an even mode characteristic impedance which is equal to N times the characteristic impedance of said input section at the junction with the input section for equal power division; and N output sections of conductive material, each output section being electromagnetically decoupled from the other output sections and each output section extending from and integral with a respective one of said tapered sections, each of said output sections having an even mode characteristic impedance which is equal to the characteristic impedance of a load and an odd mode characteristic impedance which is equal to the characteristic impedance of said load;

whereby said broadband power divider has an even mode characteristic impedance and an odd mode characteristic impedance which is equal to the characteristic impedance of said load.

10. The invention of claim 9 wherein the number N of tapered sections of conductive material is equal to four.

11. A method of designing a broadband power divider including the steps of:

a) designing an input section of conductive material;

b) designing N tapered sections of conductive material to provide N even mode subsections having a first taper and N odd mode subsections having a second taper, where N is greater than or equal to 2, extending from and integral with said input section;

c) designing N output sections of conductive material, each output section extending from and integral with a respective one of said tapered sections.

12. The invention of claim 11 including the step of designing electromagnetically decoupled sections connected to and integral with said tapered sections adapted for connection to a load.

13. The invention of claim 11 including the step of maintaining the even mode impedance of the tapered sections constant while designing electromagnetically decoupled sections connected to and integral with said tapered sections adapted for connection to a load.

14. The invention of claim 11 including the step of matching the odd mode impedance of the odd mode subsections to the impedance of said load.

15. The invention of claim 11 wherein the even mode impedances of the odd mode subsections are held constant while designing the odd mode impedance taper subsections.

16. A broadband power divider adapted for connection to a transmission line, said broadband power divider comprising:

an input section of conductive material, said input section having a characteristic impedance which is equal to the characteristic impedance of said transmission line;

N tapered sections of conductive material extending from and integral with said input section, where N is greater than two, each of said tapered sections including an even mode subsection having a first taper and an odd mode subsection having a second taper, each of each first tapered sections having an even mode characteristic impedance equal to the characteristic impedance of the input section at the junction with the input section for equal power division; and N output sections of conductive material, each output section being electromagnetically decoupled from the other output sections and each output section extending from and integral with a respective one of said tapered sections, each of said output sections having an even mode characteristic impedance which is equal to the characteristic impedance of a load and an odd mode characteristic impedance which is equal to the characteristic impedance of said load;

whereby said broadband power divider has an even mode characteristic impedance and an odd mode characteristic impedance which is equal to the characteristic impedance of said load.

* * * * *